US007367348B2

(12) United States Patent
Tsai et al.

(10) Patent No.: US 7,367,348 B2
(45) Date of Patent: May 6, 2008

(54) COLLAPSIBLE TENT STRUCTURE

(75) Inventors: Ming-liang Tsai, Taipei (TW); Chao-shun Ko, Taipei (TW)

(73) Assignee: Ming-Liang Tsai, Taipei (TW)

( * ) Notice: Subject to any disclaimer, the term of this patent is extended or adjusted under 35 U.S.C. 154(b) by 248 days.

(21) Appl. No.: 11/384,452

(22) Filed: Mar. 21, 2006

(65) Prior Publication Data

US 2007/0221262 A1 Sep. 27, 2007

(51) Int. Cl.
*E04H 15/34* (2006.01)
*E04H 15/48* (2006.01)
*E04H 15/50* (2006.01)

(52) U.S. Cl. ..... 135/145; 135/122; 135/131; 135/143; 135/144; 135/147

(58) Field of Classification Search ..... 135/121, 135/122, 131, 139, 141, 143–145, 147, 151, 135/159; 52/109
See application file for complete search history.

(56) References Cited

U.S. PATENT DOCUMENTS 6,779,538 B2 * 8/2004 Morgante et al. ..... 135/128
6,868,858 B2 * 3/2005 Suh ..... 135/145
7,168,439 B2 * 1/2007 Patel et al. ..... 135/131
2002/0059948 A1 * 5/2002 Carter ..... 135/121
2004/0079406 A1 * 4/2004 Byun ..... 135/131

* cited by examiner

*Primary Examiner*—David Dunn
*Assistant Examiner*—Danielle Jackson
(74) *Attorney, Agent, or Firm*—Rosenberg, Klein & Lee

(57) ABSTRACT

A collapsible tent structure includes a side frame and a top frame. The side frame comprises posts. Each post comprises an upper end and an upper section. The top frame comprises a top connector and top rods. Each top rod comprises an outer end and an inner end. The inner end of the top rod is pivotally connected to the top connector. Each top rod comprises two struts, a sliding bracket, a fixed bracket and a sliding socket. Each strut comprises an upper end and a lower end. The fixed bracket is secured to the upper section of the post. The sliding bracket is inserted onto the upper section of the post. The sliding socket is secured to the upper end of the post. The upper ends of the struts are pivotally connected to the top rod near the outer end of the top rod, while the lower ends of the struts are pivotally connected to the sliding bracket and the fixed bracket, respectively. The outer end of the top end is connected to the sliding socket.

4 Claims, 7 Drawing Sheets

COLLAPSIBLE TENT STRUCTURE

BACKGROUND OF THE INVENTION

1. Field of the Invention

This invention relates to a collapsible tent structure, and more particularly to a tent able to extend its top frame to expand the canopy to cover a larger area.

2. Description of the Prior Art

A conventional tent structure has a foldable design with the canopy and frame integrally formed. However, this design has a fixed size not able to expand or retract its top frame. The canopy has a suitable size to cover the area as needed.

This conventional structure was designed to have the canopy frame and the tent structure formed with many rods directly connected with connectors. This design allows the tent only to be folded or open but not to expand or retract.

SUMMARY OF THE INVENTION

It is the primary object of the present invention to provide a collapsible tent structure, which is able to extend its top frame to expand the covering area.

It is another object of the present invention to provide a collapsible tent structure, which is easy to operate.

The present invention comprises a side frame and a top frame. The side frame comprises posts. Each post comprises an upper end and an upper section. The top frame comprises a top connector and top rods. Each top rod comprises an inner end and an outer end. The inner end of each top rod is pivotally connected to the top connector. Each top rod comprises a pair of struts, a sliding bracket, a fixed bracket and a sliding socket. Each strut comprises an upper end and a lower end. The fixed bracket is secured to the upper section of the post. The sliding bracket is inserted onto the upper section of the post. The sliding socket is pivotally connected to the upper end of the post. The upper ends of the struts are pivotally connected to the top rod near the outer end of the top rod. The lower ends of the struts are pivotally connected to the sliding bracket and the fixed bracket, respectively. The outer end of the top rod is connected to the sliding socket.

DETAILED DESCRIPTION OF THE PREFERRED EMBODIMENT

Figure 1:
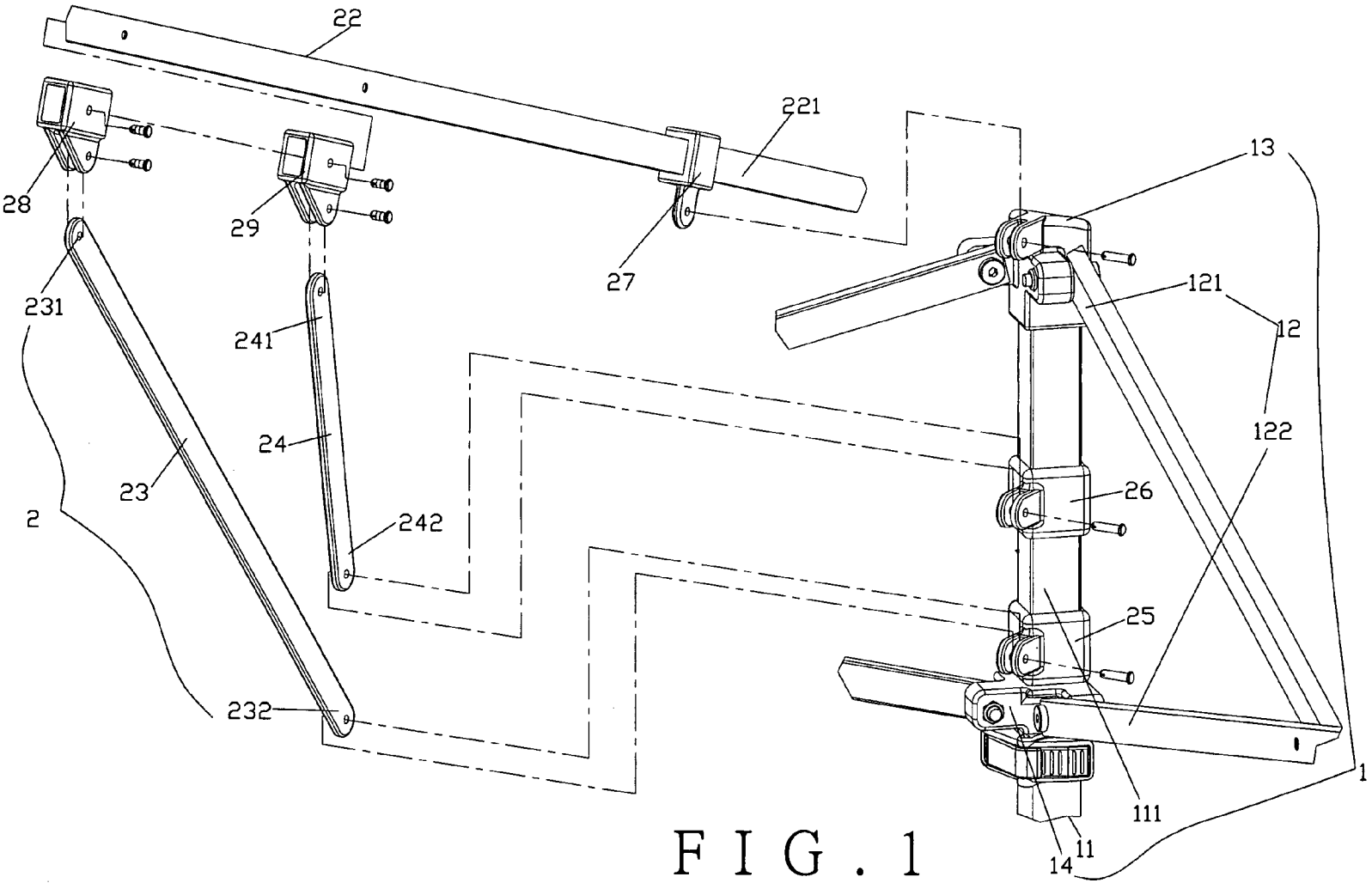
FIG. 1 is an exploded view of the present invention.
Figure 2:
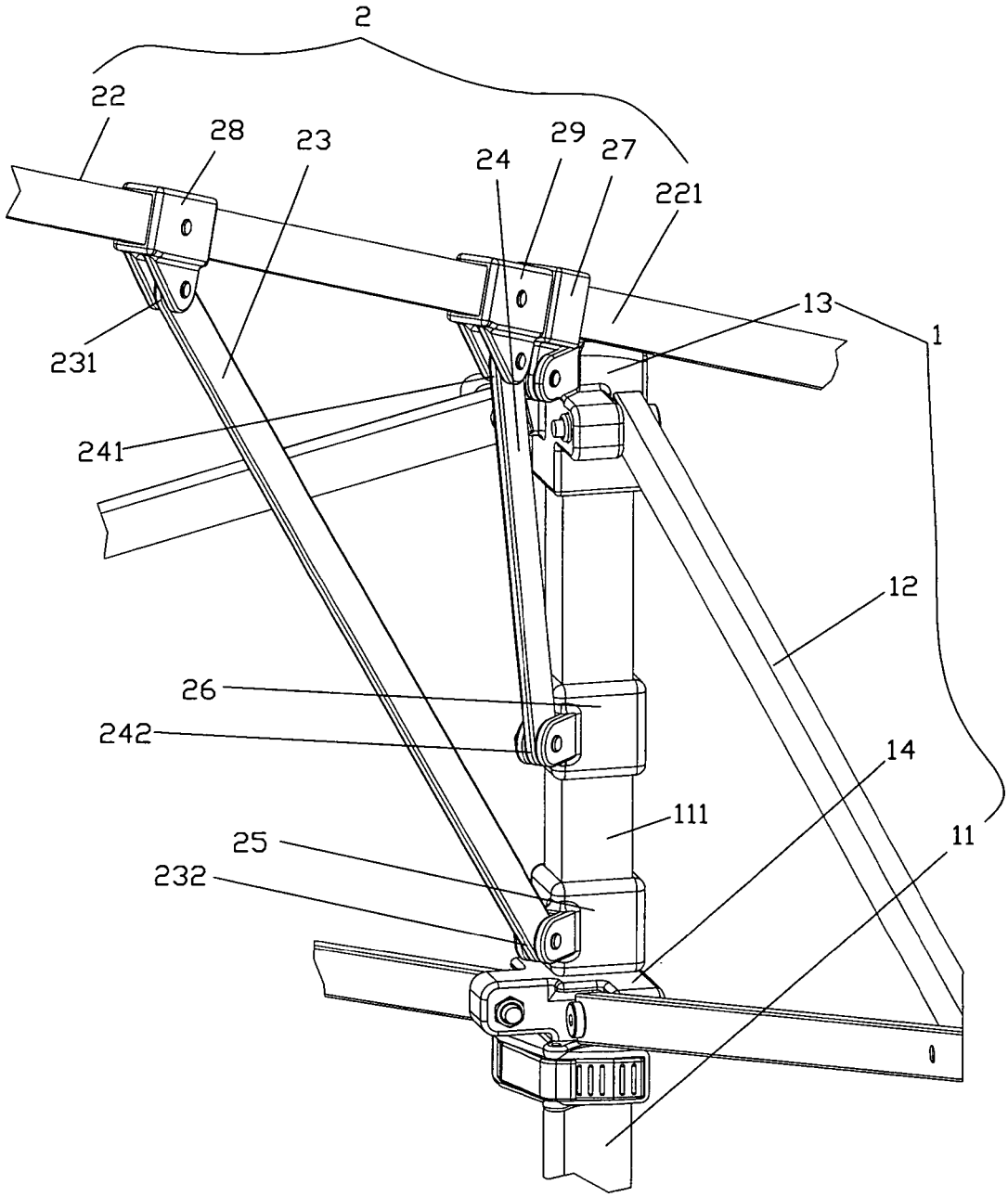
FIG. 2 is a perspective view showing the assembly of the present invention.

As shown in FIGS. 1 and 2, the present invention comprises a side frame 1 and a top frame 2. The side frame 1 comprises posts 11, linking rod sets 12, fixed connectors 13 and sliding connectors 14. Each post 11 comprises an upper end and an upper section 111. The upper end of each post 11 is connected to a relative fixed connector 13. Each sliding connector 14 is inserted onto the upper section 111 of the post 11. Each linking rod set 12 comprises a pair of upper ends 121 and lower ends 122 at respective sides. Each of the upper ends 121 is pivotally connected to the fixed connector 13 on the upper end of the post 11, while each of the lower ends 122 is pivotally connected to the sliding connector 14 on the upper section 111 of the post 11. The top frame 2, referring to FIG. 6, comprises a top connector 21 and top rods 22. Each top rod 22 comprises an outer end 221 and an inner end. The inner end of the top rod 22 is pivotally connected to the top connector 21. The inner section of the top rod 22 is collapsible.

Each top rod 22 of the top frame 2 comprises a pair of struts 23 and 24, a sliding bracket 25, a fixed bracket 26, a sliding socket 27, and a pair of rod brackets 28 and 29. The strut 23 comprises an upper end 231 and a lower end 232. The strut 24 comprises an upper end 241 and a lower end 242. The fixed bracket 26 is secured to the upper section 111 of the post 11 under the fixed connector 13. The sliding bracket 25 slides along the upper section 111 of the post 11 between the fixed bracket 26 and the sliding connector 14. The sliding socket 27 is pivotally connected to the fixed connector 13 on the top end of the post 11. The upper ends 231 and 241 of the struts 23 and 24 are pivotally connected to the top rod 22 near the outer end 221, respectively. (In the embodiment of the drawings, the upper ends 231 and 241 of the struts 23 and 24 are pivotally connected to the rod brackets 28 and 29, respectively.) The lower ends 232 and 242 of the struts 23 and 24 are pivotally connected to the sliding bracket 25 and the fixed bracket 26, respectively. The outer end 221 of the top rod 22 is inserted through the sliding socket 27 so that the canopy on the top frame 2 can be extended outwardly, which expands the area comparison with the prior art. The rod brackets 28 and 29 are secured to the top rod 22 near the outer end 221. The upper ends 231 and 241 of the struts 23 and 24 are pivotally connected to the rod brackets 28 and 29, respectively.

Figure 3:
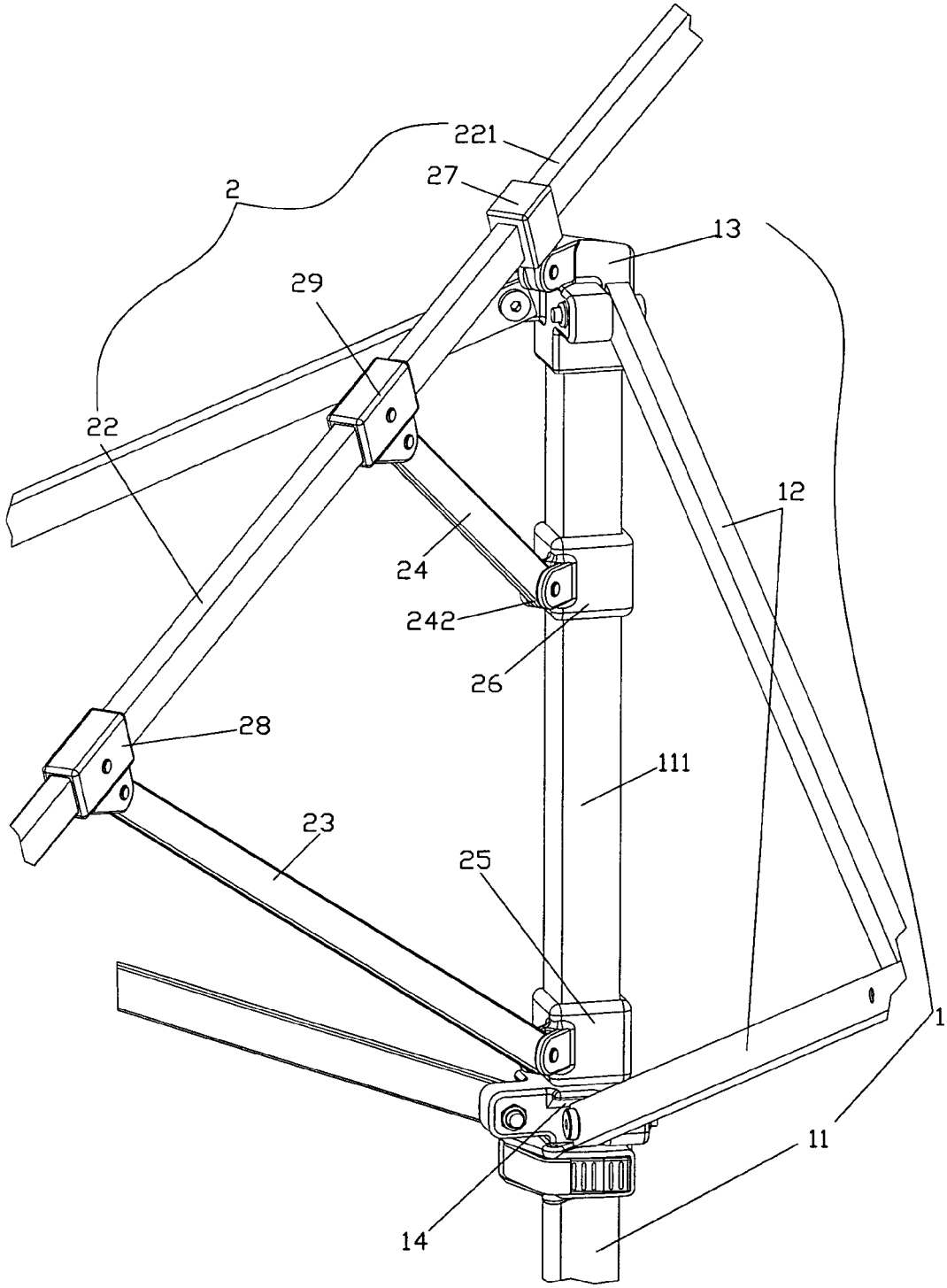
FIG. 3 is a perspective view showing the present invention in folding process.
Figure 4:
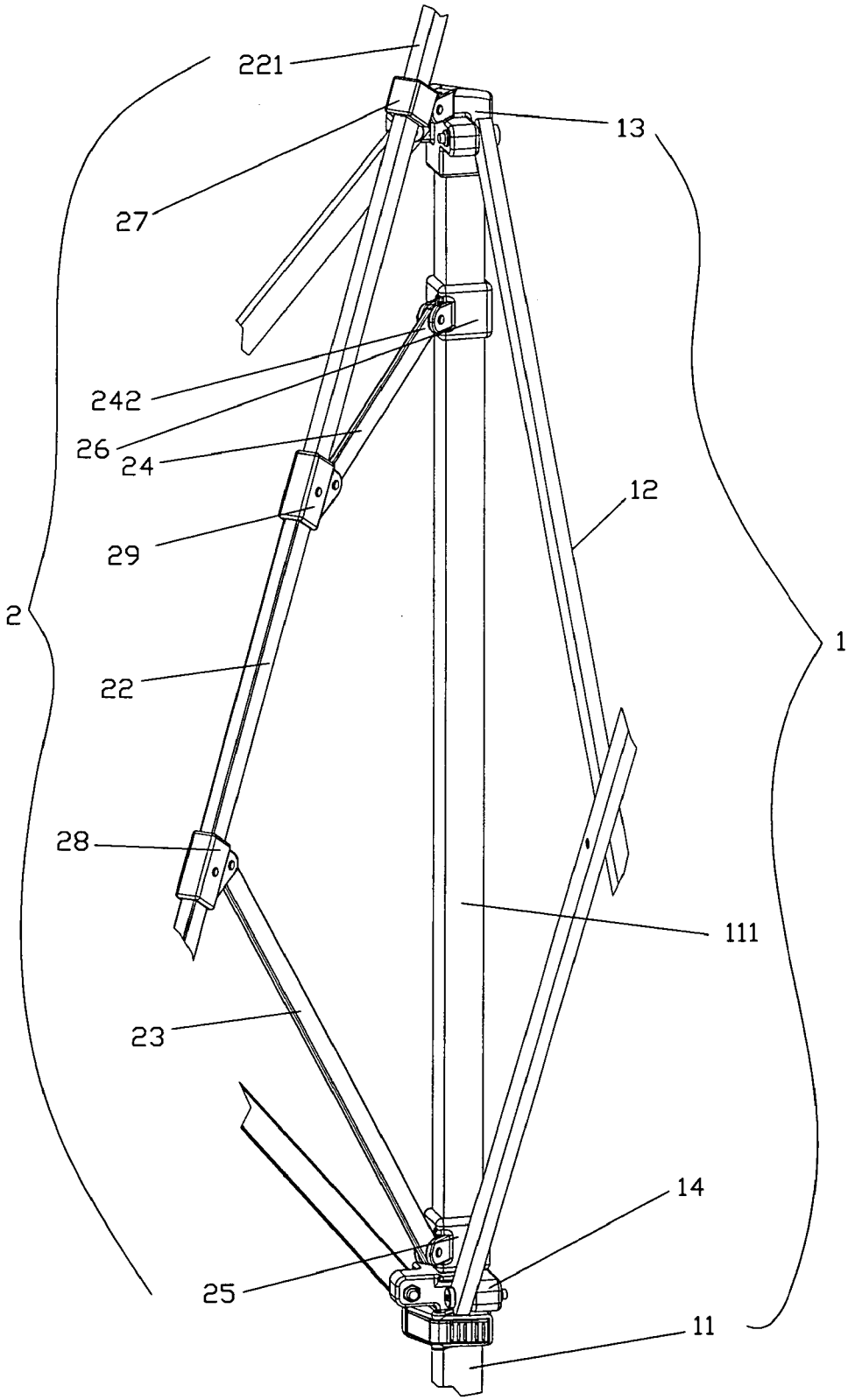
FIG. 4 is a view similar to FIG. 3 showing the present invention in a half-folded status.
Figure 5:
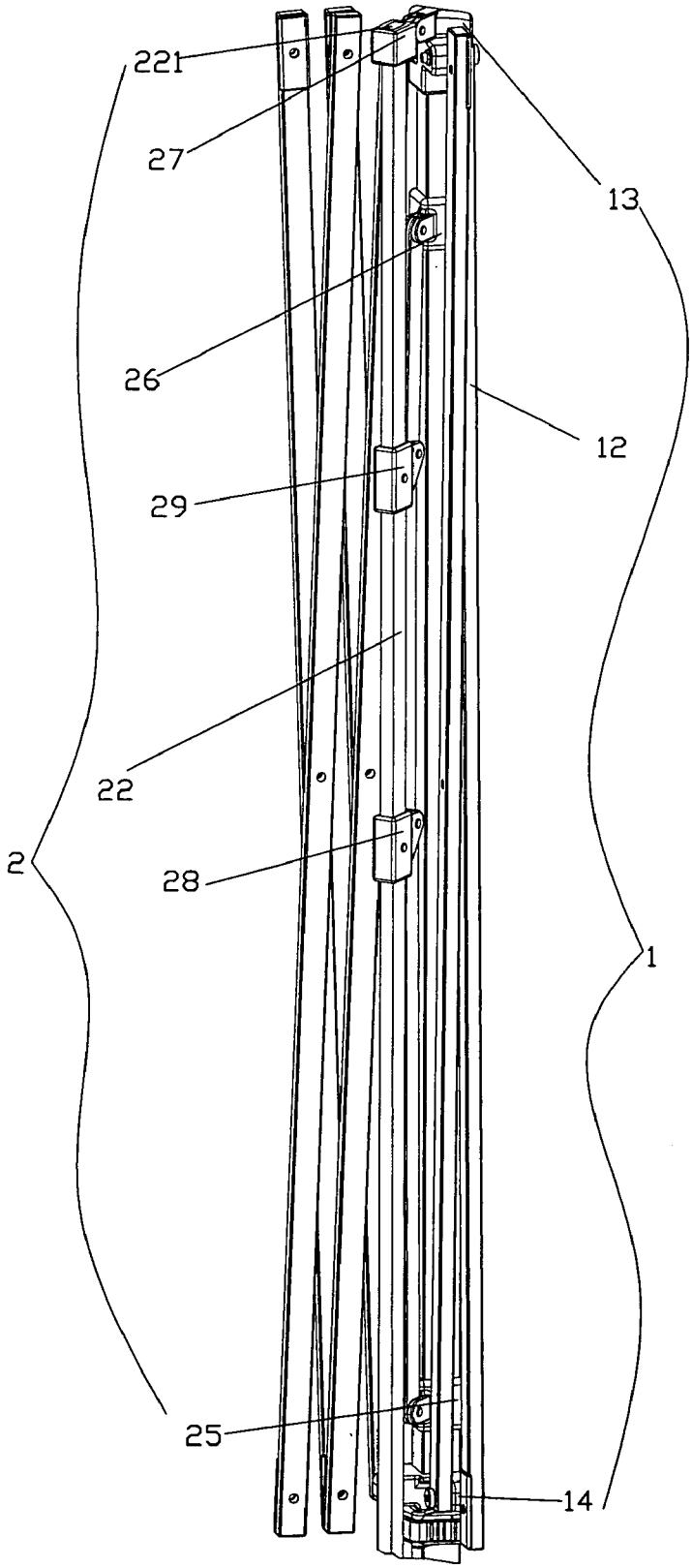
FIG. 5 is a view showing the present invention in a fully folded status.

In practice, as shown in FIGS. 3 through 6, collapse the side frame 1 slightly, as shown in FIG. 3. The top rods 22 of the top frame 2 press downward towards the inner center thereof, and the struts 23 and 24 move along the press movement. The lower end 231 of the strut 23 slides along the sliding bracket 25, as shown in FIG. 4. The tent is in a half-folded status. When the struts 23 and 24 move adjacent to the post 11, the side frame 1 is collapsed completely. The tent is in a full collapsed status, which requires very little space to store. Theoretically, all it needs is for the user to press the posts 11 of the side frame 1 to collapse the linking rod sets 12, and the tent can be collapsed completely.

Figure 6:
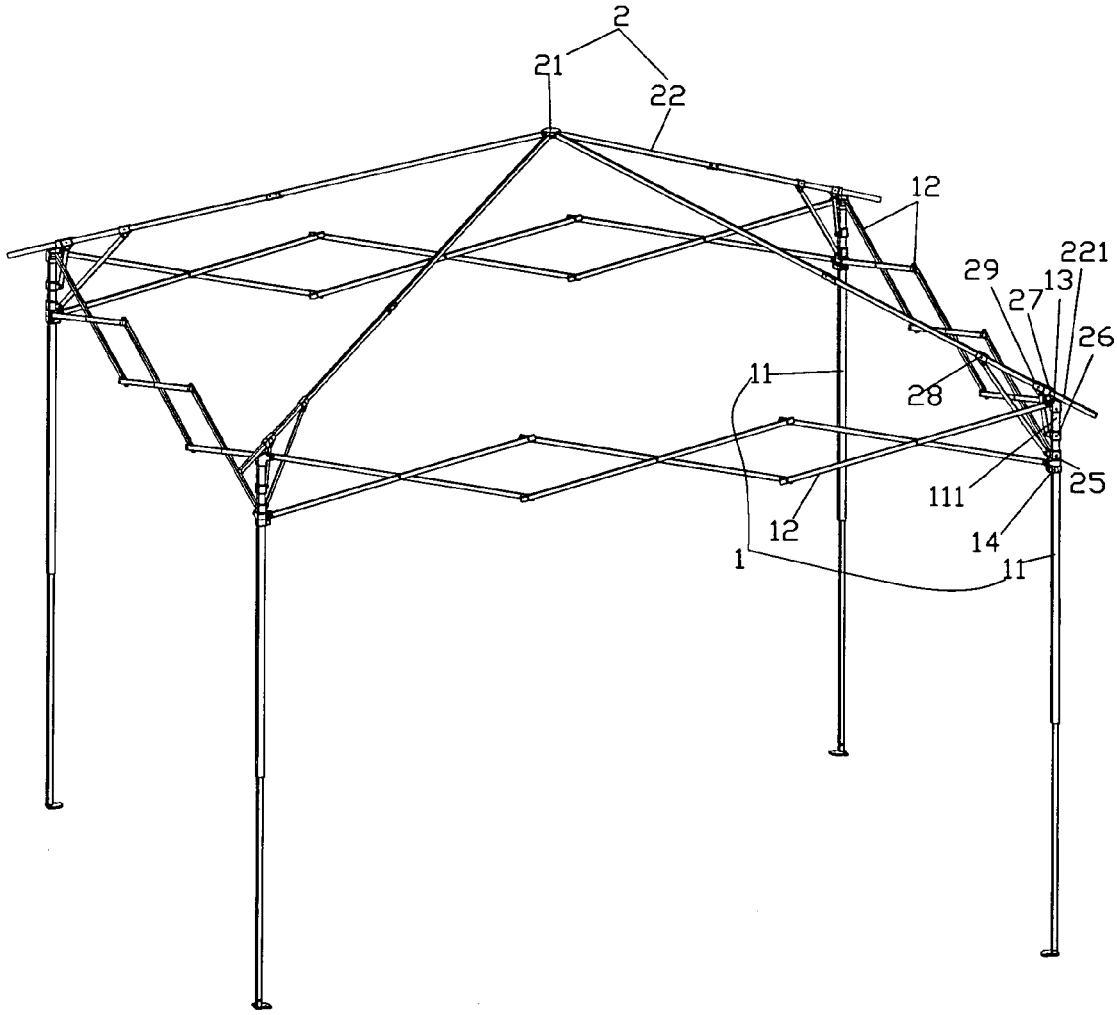
FIG. 6 is a perspective view of the present invention in a fully open status.

On the contrary, by pulling the posts 11 of the side frame 1 to extend the linking rod sets 12, the top rods 22 of the top frame 2 will raise, which links the struts 23 and 24 to rise, simultaneously, as shown in FIG. 6. The tent is in an open status. The outer end 221 of the top rod 22 at this time may be extended outwardly from the sliding socket 27, which brings the canopy outwardly to expand its coverage.

Figure 7:
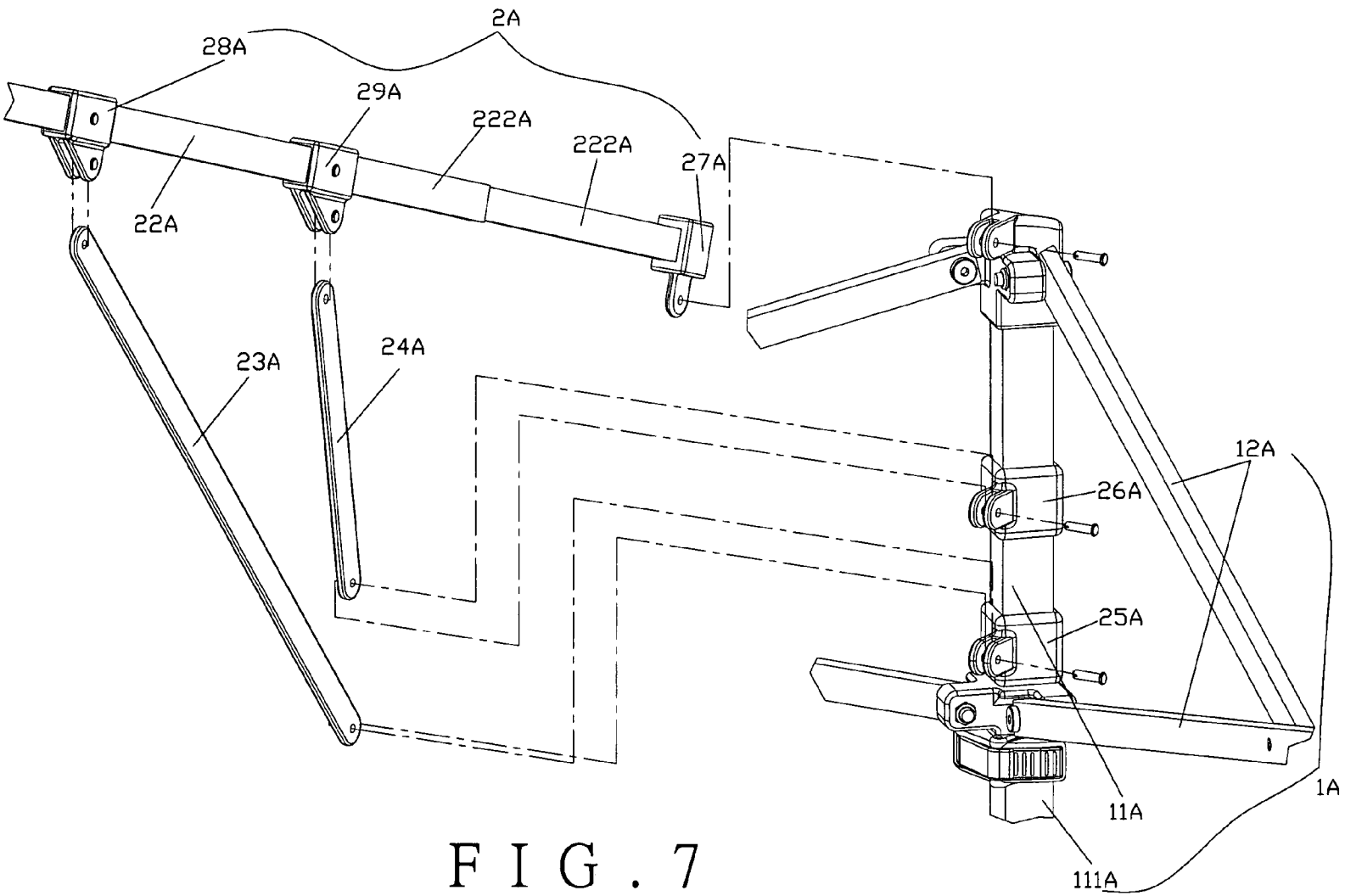
FIG. 7 is an exploded view of a second embodiment of the present invention.

FIG. 7 shows a second embodiment of the present invention, which comprises a side frame 1A and a top frame 2A. The side frame 1A comprises posts 11A and linking rod sets 12A. The top frame 2A comprises top rods 22A, struts 23A and 24A, sliding brackets 25A, fixed brackets 26A, sliding sockets 27A and rod brackets 28A and 29A. The primary difference between the first and the second embodiments is the top rod 22A of the second embodiment comprises a sliding section 222A. The sliding section 222A is inserted into the top rod 22A with the outer end secured to the sliding socket 27A.

What is claimed is:

1. A collapsible tent structure comprising a side frame and a top frame, said side frame comprising posts, each post comprising an upper end and an upper section, said top frame comprising a top connector and top rods, each said top rod comprising an inner end and an outer end, the inner end of each said top rod being pivotally connected to said top connector, and characterized by:

each said top rod comprising a pair of struts, a sliding bracket, a fixed bracket and a sliding socket, each said strut comprising an upper end and a lower end, said fixed bracket being secured to the upper section of said post, said sliding bracket is inserted onto the upper section of said post, said sliding socket being pivotally connected to the upper end of said post, the upper ends of said struts being pivotally connected to said top rod near the outer end of said top rod, the lower ends of said struts being pivotally connected to said sliding bracket and said fixed bracket, respectively, and the outer end of said top rod being connected to said sliding socket.

2. The collapsible tent structure, as recited in claim 1, wherein the outer end of said top rod is inserted through said sliding socket.

3. The collapsible tent structure, as recited in claim 1, wherein said top rod comprises a sliding section, said sliding section able to slide within said top rod with an outer end secured to said sliding socket.

4. The collapsible tent structure, as recited in claim 1, wherein each said top rod comprises a pair of rod brackets, said rod brackets being secured to said top rod near the outer end of said top rod, the upper ends of said struts being pivotally connected to said rod brackets.

* * * * *